United States Patent [19]

Fry

[11] Patent Number: 4,752,190

[45] Date of Patent: Jun. 21, 1988

[54] COMPRESSOR CYLINDER HEAD

[75] Inventor: Emanuel D. Fry, Tecumseh, Mich.

[73] Assignee: Tecumseh Products Company, Tecumseh, Mich.

[21] Appl. No.: 876,279

[22] Filed: Jun. 18, 1986

[51] Int. Cl.[4] ..... B23P 15/00

[52] U.S. Cl. ..... 417/238; 417/454; 29/407; 29/196.4 R; 29/156.5 R; 92/60.5

[58] Field of Search ..... 29/407, 156.4 R, 156.5 R; 137/454.4, 512.1, 516.15, 516.23, 454.6; 417/235, 454; 92/60.5

[56] References Cited

U.S. PATENT DOCUMENTS

| | | | |
|---|---|---|---|
| 1,901,478 | 3/1933 | Sutton et al. . | |
| 2,613,870 | 10/1952 | Borgerd | 230/230 |
| 2,647,683 | 8/1953 | Schweller | 230/21 |
| 2,948,461 | 8/1960 | Frank | 230/232 |
| 3,050,237 | 8/1962 | Nicholas | 230/231 |
| 3,689,199 | 9/1972 | Bassinger | 417/273 |
| 3,829,253 | 8/1974 | Bunn et al. | 417/504 |
| 4,115,044 | 9/1978 | Gannaway | 417/564 |
| 4,408,389 | 10/1983 | Heneir | 29/407 X |
| 4,416,190 | 11/1983 | Ishizuka | 417/269 X |
| 4,532,685 | 8/1985 | Itoh et al. | 29/407 X |

*Primary Examiner*—Carlton R. Croyle
*Assistant Examiner*—Theodore Olds
*Attorney, Agent, or Firm*—Jeffers, Hoffman & Niewyk

[57] ABSTRACT

A compressor cylinder head assembly for a compressor which has a crankcase and a plurality of cylinders disposed in the crankcase. Each valve plate is spaced from the cylinder head by a valve plate gasket which is selected to have a thickness to provide the proper amount of clearance between the top of the piston and the valve plate to thereby keep the cylinder clearance in a predetermined range.

7 Claims, 3 Drawing Sheets

COMPRESSOR CYLINDER HEAD

BACKGROUND OF THE INVENTION

This invention relates to multicylinder reciprocating compressors for use in refrigeration systems. More particularly, this invention relates to such compressors wherein the reexpansion volume of each cylinder is optimized.

Prior art multicylinder reciprocating compressors have generally used a unitary valve plate to cover all of the cylinders of the compressor. Such valve plates are generally comprised of a single, unitary, relatively massive steel or cast iron plate which is sealed to the crankcase of the compressor by means of a unitary head gasket. In the compressor environment, the cylinder clearance is generally referred to as the distance within the cylinder between the top of the piston and the valve plate when the piston is at the farthest extension of its stroke, commonly referred to as the top dead center position. Such prior art compressor head gaskets are selected so that the minimum cylinder clearance of the piston having the maximum extension is greater than a predetermined desired limit. Thus, in such prior art arrangements, the maximum cylinder clearance of the pistons, due to manufacturing tolerances, is uncontrolled. It is desired to hold cylinder clearance to a minimum since the compressor capacity and efficiency are thereby optimized. In operation, as the piston reciprocates within the cylinder, the volume of gas which occupies the clearance volume of the cylinder is repeatedly compressed and expanded without resulting in any useful work. It is, therefore, desired to minimize the cylinder clearance volume and to thereby minimize the lost work by providing a compressor wherein the cylinder clearance of each individual cylinder is adjusted during assembly of the compressor to minimize the cylinder clearance volume.

In one prior U.S. Pat. No. 2,647,683, cylinder clearance has been adjusted by means of an adjustable plug which is threadedly received in the compressor cylinder to provide a predetermined cylinder clearance within the compressor. However, this prior art structure is relatively complicated and is therefore relatively expensive to manufacture. It is therefore desired to provide a multicylinder compressor with an adjustable cylinder clearance volume which is structurally simple and inexpensive to manufacture.

In another U.S. Pat. No. 2,613,870, the adjustable cylinder clearance volume has been provided by means of a thin valve plate which may be deformed to provide more or less "dishing". This prior art structure is also relatively complicated and uses several parts to perform this "dishing" function and is therefore undesirable. It is therefore desired to provide a reciprocating compressor wherein no extra parts are used to provide an adjustable cylinder clearance volume.

SUMMARY OF THE INVENTION

The present invention overcomes the disadvantages of the above-described prior art reciprocating compressors by providing a method for assembling a reciprocating compressor whereby an adjustable cylinder clearance volume is provided. The invention furthermore provides such a method which may be used in the assembly of each valve plate assembly in a multicylinder compressor.

The method, according to the present invention, in one form thereof, comprises providing a plurality of valve plate gaskets which have various thicknesses. A desired cylinder clearance is first selected. The compressor crankshaft is rotated to move the piston to its top dead center position, and the distance between the piston and the cylinder deck is measured. A valve plate gasket is then selected from a plurality of available gaskets so that the clearance between the valve plate and the top of the piston is the desired selected amount of clearance.

The reciprocating compressor, according to the present invention, in one form thereof, includes a universal valve plate which is provided with a circumferential groove around its perimeter in which a resilient O-ring is seated to seal the valve plate to the crankcase. The valve plate gasket is interposed between the valve plate and the crankcase and comprises a ring of soft aluminum or brass and having a thickness which is selected to provide the optimum predetermined clearance between the top of the piston and the valve plate. The valve plate may be manufactured of powdered metal or other suitable material which requires a minimum of machining operations.

One advantage of a compressor according to the present invention is that the clearance volume for each individual cylinder is optimized, thereby providing a compressor having maximum capacity and efficiency.

Another advantage of the present invention is that in a multicylinder compressor the valve plates, which have a relatively intricate design, may be manufactured from powdered metal, thereby eliminating machining steps in the manufacture of the valve plates and resulting in manufacturing efficiencies.

A further advantage of the present invention is that by using resilient O-rings to seal the valve plates to the crankcase, the sound generated in the compressor by the opening and closing of the valves is dampened, thereby resulting in a quieter compressor.

Still another advantage of the present invention is that, by the utilization of small, universal valve plates in a multicylinder compressor, the total weight of the compressor is reduced.

The present invention, in one form thereof, comprises a method for assembling a reciprocating compressor and for optimizing the compressor cylinder reexpansion volume. The compressor includes a crankcase, a cylinder head secured to the crankcase, a cylinder bore disposed in the crankcase and a piston located in the bore. A crankshaft drives the piston. There is also provided a valve plate and a plurality of valve plate gaskets which have a plurality of thicknesses spanning a predetermined range of thicknesses. The method comprises selecting a desired piston clearance, rotating the crankshaft to move the piston to its top dead center position and then measuring the extension between the piston and the cylinder head. The valve plate gasket is then selected from the plurality of gaskets based on the extension measurement and the selected piston clearance.

The present invention, in one form thereof, comprises a reciprocating compressor having a crankcase and a plurality of cylinders disposed in the crankcase. Each of the cylinders includes a piston and a valve plate. A means is provided for selecting a predetermined clearance between the piston and its associated valve plate and comprises a valve plate gasket interposed between the crankcase and the associated valve plate and wherein the valve plate gasket has a thickness which assures the predetermined clearance.

The present invention, in one form thereof, comprises a multicylinder reciprocating compressor including a crankcase and a plurality of pistons respectively operatively associated with each cylinder. A plurality of valve plates is respectively operatively associated with each cylinder. Each valve plate includes a circumferential groove along its outer periphery. A resilient sealing means is disposed in each of the circumferential grooves. A valve plate gasket is operatively associated with each cylinder. Each valve plate gasket has a selected thickness based on the extension of its associated piston and the predetermined clearance of the associated piston.

It is an object of the present invention to provide a multicylinder reciprocating compressor wherein the clearance volume of each individual cylinder may be adjusted and minimized.

It is a further object of the present invention to provide a method of assembling a reciprocating compressor wherein the clearance volume of each individual cylinder may be minimized.

Another object of the present invention is to provide a reciprocating compressor wherein the valve plate gaskets may be selected based upon the desired clearance between the piston and the valve plate.

Still another object of the present invention is to provide a circumferential "0" ring seal for compressor valve plates to reduce compressor noise.

Yet another object of the invention is to provide a multicylinder compressor wherein powdered metal valve plates may be used.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
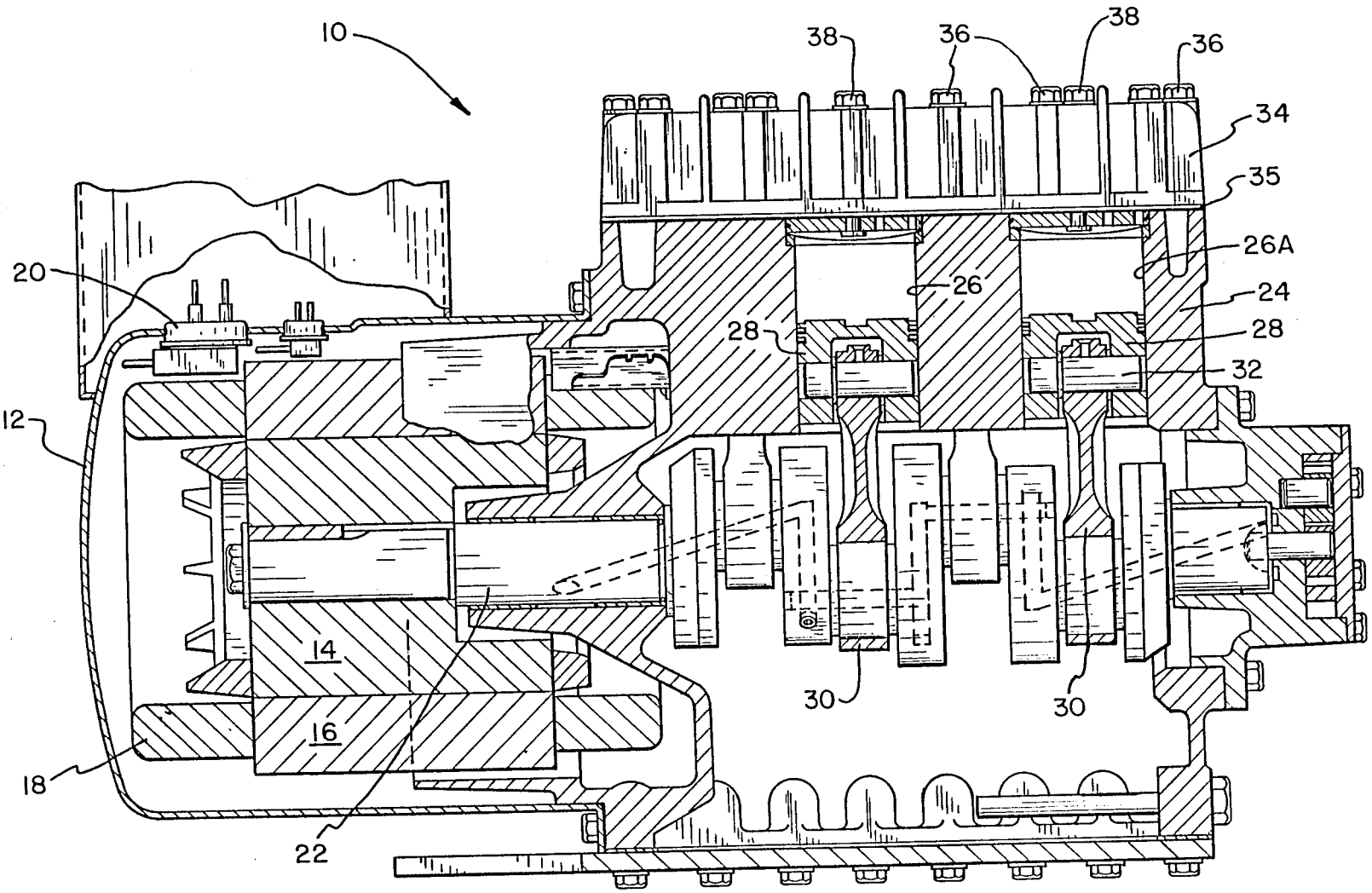
FIG. 1 is an elevational sectional view of a compressor incorporating a preferred embodiment of the present invention.

Referring now to FIG. 1, there is shown a reciprocating compressor 10 including an electric motor 12 for driving the compressor. The electric motor 12 includes a rotor 14 and a stator 16. The stator windings are indicated at 18. An electrical connector 20 is provided to connect the motor to a source of electrical supply.

The construction of the motor housing and the flow of suction refrigerant gas therethrough is further described in U.S. application Ser. No. 06/877,000, filed on even date herewith and which is assigned to the assignee of the present invention.

Rotor 14 is connected to a crankshaft 22 which is rotatably disposed inside a crankcase 24. Crankcase 24 includes a plurality of cylinders 26. In the disclosed embodiment, two cylinders 26 are shown although the number of cylinders 26 may be varied as desired. Each cylinder 26 is provided with a piston 28 which is reciprocably housed in the cylinder 26 as is conventional.

Figure 2:
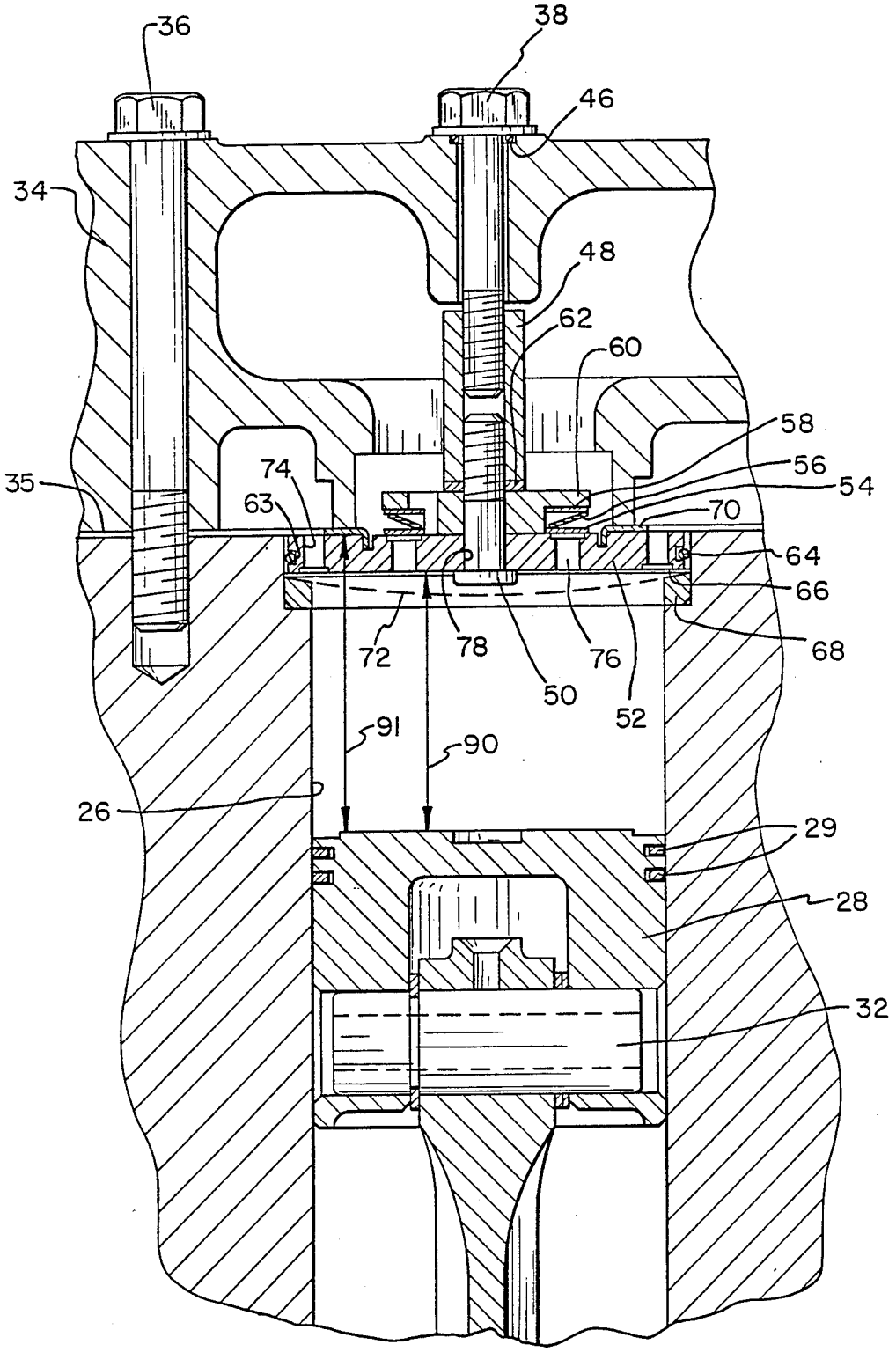
FIG. 2 is an enlarged sectional view of a cylinder and piston arrangement for the compressor of FIG. 1.
Figure 3:
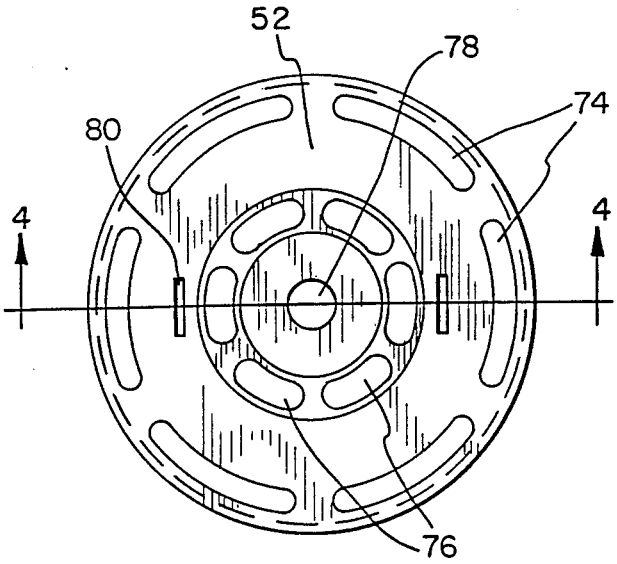
FIG. 3 is a plan view of a valve plate for use with the compressor of FIG. 1.
Figure 4:
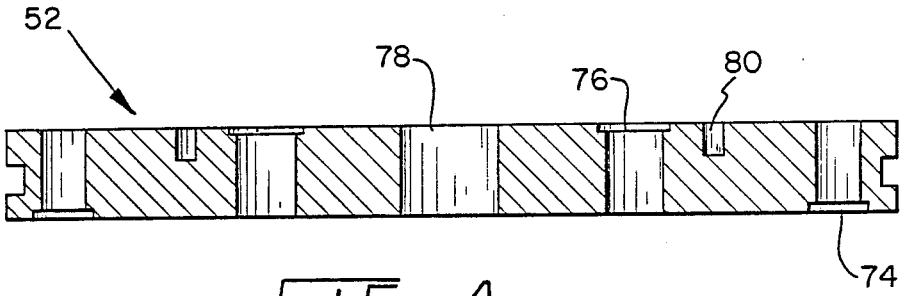
FIG. 4 is an enlarged side elevational view of the valve plate of FIG. 3.

Referring now to FIGS. 1 and 2, each piston 28 includes a plurality of piston rings 32 as is conventional. Cylinder head 34 is spaced from crankcase 24 by head gasket 35 and is secured to crankcase 24 by means of a plurality of bolts 36. A plurality of valve plate assembly bolts 38 are also disposed in cylinder head 34 and are sealed thereto by means of O-rings 46 to prevent escape of compressed refrigerant through the apertures in which bolts 38 are disposed. Bolts 38 are threaded into retaining nuts 48. Each cylinder 26 is provided with a valve plate 52. Retaining nuts 48 also have secured therein valve plate screws 50 for securing valve plates 52 to cylinder head 34. Thus, cylinder head 34 has securely fastened thereto, by means of bolts 38 and screws 50, the valve plates 52. As best seen in FIGS. 2 and 3, each valve plate 52 includes an aperture 78 in which a valve plate screw 50 is disposed. Furthermore, each valve plate 52 includes a plurality of suction ports 74 and discharge ports 76. Discharge ports 76 are provided with discharge leaves 54 for selectively closing off discharge ports 76. Furthermore, each discharge port 76 is provided with an exhaust valve leaf spring 56, an exhaust leaf retainer 58, and an exhaust valve leaf retainer 60, as is conventional. Lastly, a lock washer 62 is provided between each exhaust valve leaf retainer 60 and retaining nut 48 whereby valve plate screws 50 retain the exhaust valve structure assembly securely in place.

Valve plate 52 is also provided with a circumferential groove 63 around its outer periphery in which an O-ring 64 is seated, thereby sealing valve plate 52 to the crankcase 24. The O-ring 64 may be constructed of an oil resistant rubber material such as neoprene. This material is resilient and flexible and thereby seals the cylinder 26 whereby compressed refrigerant must exit from the cylinder 26 through exhaust ports 76 in valve plate 52.

Figure 6:
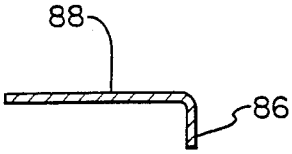
FIG. 6 is a partial sectional view of the valve plate gasket of FIG. 5 taken along line 6—6 thereof.
Figure 5:
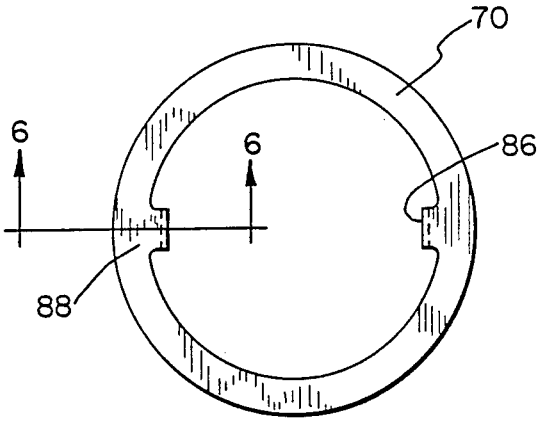
FIG. 5 is a plan view of a valve plate gasket for the compressor of FIG. 1.

Referring now to FIGS. 2, 5, and 6, each cylinder 26 is provided with an intake valve leaf 66 which flexes inwardly when piston 28 moves downwardly to draw refrigerant into cylinder 26 through valve plate suction ports 74. Suction leaf retainers 68 secure valve leaf 66 in place and prevent excessive flexing thereof. In its fully open position, intake valve leaf 66 is in the position as indicated in dotted lines at 72. Each valve plate assembly further includes a valve plate gasket 70 which is captured between a valve plate 52 and cylinder head 34. Gasket 70 includes two tab or bight portions 86 which are captured in slots 80 disposed in valve plate 52 for proper alignment of gasket 70 with valve plate 52. A connecting portion 88 connects tabs 86 with the main portion of ring-shaped gasket 70. Valve plate gasket 70 may be comprised of a soft and ductile aluminum, aluminum alloy or brass.

Valve plate gasket 70 is supplied in various thickness so that, during assembly, the clearance between the top of the piston 28 when it is in its fully extended position, sometimes referred to as the top dead center position, and the bottom of the valve plate 52 may be kept to a minimum. The clearance distance, referred to as the cylinder clearance, is indicated at 90 in FIG. 2. Cylinder clearance 90 defines the amount of space in cylinder 26 and the volume of gas in cylinder 26 when the piston 28 comes to the end of its compression stroke. By holding the cylinder clearance volume to a minimum, compressor capacity is maximized and by increasing the clearance volume, the capacity of the compressor is reduced. Thus, during the upward stroke of piston 28 as shown in FIG. 2, the gas in the clearance volume will be compressed, and during the downward stroke, the gas in the clearance volume will expand. Thus, no useful work is performed by the gas which occupies this clearance volume and the energy expended during recompression constitutes lost work. It is therefore desired to keep the clearance or reexpansion volume to a minimum to keep the lost work to a minimum. Stated in another way, if the compressor is designed to have a large volumetric cylinder clearance and is driven by an electric motor of predetermined capacity, the cylinder clearance of the compressor may be reduced to increase the capacity and efficiency of the compressor within the predetermined limits without overloading and damaging the electric driving motor. Thus, if the clearance volume or reexpansion volume is kept to a minimum, the efficiency and capacity of the compressor are optimized, thus permitting the compressor to be applied to larger refrigeration systems than would otherwise be possible.

In the prior art systems, the clearance volume for multicylinder compressors was chosen to be the minimum for the piston having the greatest extension. The clearance volumes for the remaining cylinders were therefore uncontrolled. There could thus be a great variation in the clearance volumes of the remaining cylinders, depending on manufacturing tolerances. In the embodiment of the invention disclosed herein, the clearance volume is optimized for each individual cylinder 26.

The method of assembly is as follows. A desired piston clearance range is first selected which determines the optimum clearance volume. The pistons 28 are assembled in cylinders 26 and crankshaft 22 is rotated so that one of the pistons 28 will move to its top dead center or uppermost position. The distance between the top of the piston 28 and the cylinder head 34 is then measured to indicate the extension of piston 28. Based on this measurement, a valve plate gasket 70 is selected with a thickness in a range to cause the clearance between the bottom of the assembled valve plate 52 and the top of the piston, as indicated by dimension 90, to be within the desired optimum range. The valve assembly is then assembled to cylinder head 34 using the selected valve plate gasket 70. The assembly procedure is then repeated for each valve plate assembly so that each cylinder clearance volume is optimized.

As an example, assume that it is desired to have a piston clearance 90 in the range of 0.006 inch to 0.012 inch. Further, if the piston extension as measured from the cylinder deck or top surface of the crankcase 24, as indicated by arrow 91, to the top of the piston 28 is 0.275 inch. Lastly, if the cylinder head gasket 35 has a thickness of 0.026 inches, then a valve plate gasket 70 would be selected in the thickness range of 0.016 to 0.0199 thereby providing a clearance for piston 28 in the range of 0.006 to 0.012 which is the optimum desired clearance range of the piston. In the embodiment shown, the valve plate gaskets are available in five size ranges, as indicated in Table I as follows:

TABLE I

| VALVE PLATE GASKET IDENTIFICATION | THICKNESS |
|---|---|
| A | .012-.0159 |
| B | .016-.0199 |
| C | .020-.0239 |
| D | .024-.0279 |
| E | .028-.0319 |

The gasket selected for a particular cylinder is the gasket which most nearly causes the piston clearance to be in the selected predetermined range. It should be understood that more or fewer size ranges could be provided.

Thus, it can be seen that each cylinder 26 of the multicylinder compressor is provided with an optimum cylinder clearance thereby optimizing the efficiency and capacity of the compressor.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is clamed is:

1. In a reciprocating compressor having a crankcase which includes a cylinder deck, a cylinder head, means for securing said cylinder head on said cylinder deck, a plurality of cylinders disposed in said crankcase, each of said cylinders having a piston and a valve plate associated therewith, the top of each said piston, spaced an extension distance from said cylinder deck, means for securing each said valve plate to said cylinder head, means for selecting a predetermined clearance between each said piston and its associated valve plate comprising a valve plate gasket interposed between said cylinder head and said associated valve plate, said valve plate gasket having a selected thickness dimension which is a function of said extension distance and said predetermined selected clearance.

2. The compressor according to claim 1 wherein each said valve plate is comprised of powdered metal.

3. The compressor of claim 1 wherein each said valve plate includes a circumferential groove around its outer perimeter, said compressor further including a resilient ring member seated in said groove to seal said valve plate to said crank case.

4. The compressor of claim 1 wherein each said valve plate gasket is comprised of a soft metal material.

5. In a multicylinder reciprocating compressor including a crankcase having a cylinder deck, a cylinder head, means for securing said cylinder head on said cylinder deck, a plurality of pistons respectively operatively associated with each cylinder, each said piston in the top dead center position thereof being spaced an extension distance from said cylinder deck, a plurality of valve plates respectively operatively associated with each cylinder, each said valve plate including a circumferential groove along its outer periphery, resilient sealing means disposed in each said circumferential groove, a valve plate gasket operatively associated with each cylinder, each said valve plate gasket having a selected thickness which is a function of the extension distance of its associated piston and the predetermined clearance between the valve plate and its associated piston, and means for securing each said valve plate to said cylinder head.

6. The compressor according to claim 5 wherein each said valve plate is comprised of powdered metal.

7. The compressor of claim 5 wherein each said valve plate gasket is comprised of a soft metal material.

* * * * *

UNITED STATES PATENT AND TRADEMARK OFFICE

CERTIFICATE OF CORRECTION

PATENT NO. : 4,752,190

DATED : June 21, 1988

INVENTOR(S) : Emanuel Duane Fry

It is certified that error appears in the above-identified patent and that said Letters Patent is hereby corrected as shown below:

Claim 1, Col. 6, line 40, after "piston" insert --in the top dead center position thereof--.

Signed and Sealed this

Sixth Day of December, 1988

*Attest:*

*Attesting Officer*

DONALD J. QUIGG

*Commissioner of Patents and Trademarks*